United States Patent [19]

Foik

[11] 3,995,829

[45] Dec. 7, 1976

[54] TUBE DRIVING APPARATUS

[75] Inventor: Adolf Foik, Munich-Krailling, Germany

[73] Assignee: Gewerkschaft Eisenhutte Westfalia, Germany

[22] Filed: Jan. 2, 1976

[21] Appl. No.: 646,329

[30] Foreign Application Priority Data

Jan. 9, 1975 Germany ..... 2500614

[52] U.S. Cl. ..... 254/29 R

[51] Int. Cl.² ..... E21B 19/00

[58] Field of Search ..... 254/29 R

[56] References Cited

UNITED STATES PATENTS

| | | | |
|---|---|---|---|
| 1,962,228 | 6/1934 | Abramson et al. | 254/29 R |
| 2,080,104 | 5/1937 | Abramson et al. | 254/29 R |
| 3,005,314 | 10/1961 | Cunningham | 254/29 R |
| 3,908,960 | 9/1975 | Bagley | 254/29 R |

*Primary Examiner*—James L. Jones, Jr.
*Assistant Examiner*—Robert C. Watson
*Attorney, Agent, or Firm*—Thompson, Birch, Gauthier & Samuels

[57] ABSTRACT

A tube-driving apparatus which has a frame with floor-engaging beams and abutment-forming beams arranged perpendicular thereto. A pressure ring, which engages on a pipe or tube to be driven, is supported by guide shoes slidably engaging on the floor beams.

Piston and cylinder units are coupled with ball-and-socket joints to the pressure ring and the abutment-forming beams and serve to advance the ring to drive the pipe into the ground. A pivotable rail is located by guide means on the exterior of the ring and is adjusted to partly rotate the ring about its axis parallel to the floor beams to set up a controllable torsional force in the ring which can be imparted to the driven pipe.

17 Claims, 3 Drawing Figures

TUBE DRIVING APPARATUS

BACKGROUND OF THE INVENTION

The present invention relates to apparatus for driving pipe, or similar hollow tubular structures, hereinafter referred to simply as pipes, into the ground to form an underground pipe line.

Tube driving apparatuses usually comprise some form of rigid framework which is installed into an underground excavation and hydraulic piston and cylinder units supported on the framework and connected to a pressure ring which serves to engage on a pipe to be driven. Pipes are then driven into the ground successively by operation of the units to form a pipe line. It has been found that with such an arrangement it is quite common for the pipes to partly rotate about their longitudinal axes as they are advanced. This is disadvantageous since it can result in a certain residial torsional stress being set up in the pipes. Moreover where other equipment such as conveyors or the like is to be arranged inside the pipe line further problems can arise due to the undesirable rotary motion of the pipes. Although proposals have been made to overcome this problem, including rotatably supporting the pressure ring, hitherto there has been no wholly successive means for controlling the torsional force imparted to the pipes during the driving operation.

A general object of this invention is to provide an improved form of tube-driving apparatus.

SUMMARY OF THE INVENTION

Starting from the known proposal of permitting the pressure ring to rotate the invention provides a means for adjusting and pre-setting the rotational position of the ring and for maintaining this position to set up a torsional force in the ring which can be transmitted to the pipes. It can be arranged for the torsional force thus created to counteract any torsional force produced by the driving process per se.

In its broadest aspect the invention provides a tube-driving apparatus which includes force-applying means engageable with a pipe and movable to drive said pipe into the ground, means for mounting said force-applying means for movement about a rotational axis extending parallel to the driving direction and means for pre-adjusting the force-applying means in relation to said rotational axis whereby to control the torsional force imparted to the pipe during the driving operation.

In another aspect the invention provides a tube-driving apparatus comprising pressure means engageable with a pipe, power means for moving the pressure means to drive said pipe into the ground, resilient means flexibly interconnecting the pressure means to the power means and means for adjusting the pressure means about an axis extending parallel to the driving direction to set up a torsional force in the pressure means whereby to control the torsion imparted to the driven pipe.

The invention also provides a tube-driving apparatus comprising a pressure ring supported for axial and rotary movement and engageable with a pipe to be driven, piston and cylinder units for moving the ring axially to urge said tube into the ground and means for adjusting the position of the ring about its rotational axis to create torsional force in the ring whereby to control the torsion in the driven pipe. In one simple form the adjusting means comprises a rail locating on the exterior of the ring and displaceable transversally to the rotational axis of the ring. The rail can be pivoted and a mechanism can then be provided for varying the pivotal position of the rail. To accommodate the rotary movement of the ring the piston and cylinder units are connected to the ring with the aid of flexible means preferably ball-and-socket joints. Pivoting of the rail can partly rotate the ring so that when the piston and cylinder units extend to advance a pipe the ring will have a certain torque which can counteract any naturally occurring torsion imparted to the driven pipe. The controlled adjustment of the ring will be maintained during driving and preferably guide means is provided to act between the ring and the rail.

The apparatus can employ a frame with floor-engaging beams and further beams which form a thrust abutment for the piston and cylinder units. It is preferable for the pressure ring to be supported by guide shoes slidably engaging on the floor beams of the frame. Preferably the pivotal axis of the rail is disposed at the side of the ring nearest the units while the adjusting mechanism is disposed at the opposite side of the ring. The rail can extend between lugs on the ring which carry the aforementioned guide means and the rail can rest on the floor of the excavation in which the apparatus is installed.

In its simplest form the adjusting mechanism can comprise set screws abutting or engaging on opposite sides of the rail although a spindle or a further piston and cylinder unit can be employed.

The invention may be understood more readily, and various other features of the invention may become more apparent, from consideration of the following description.

BRIEF DESCRIPTION OF DRAWINGS

An embodiment of the invention will now be described, by way of example only, with reference to the accompanying drawing, wherein.

DESCRIPTION OF PREFERRED EMBODIMENT

Figure 1:
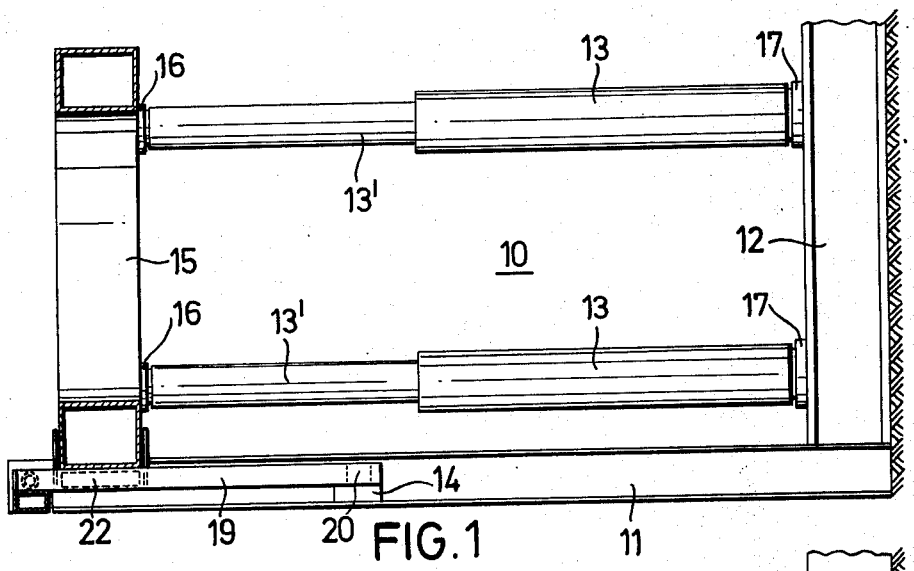
FIG. 1 is a schematic part-sectional side view of an apparatus made in accordance with the invention.

As shown in the drawing, the apparatus has a main frame composed of a pair of parallel floor beams 11 rigidly connected with a pair of upstanding parallel rear beams 12 arranged perpendicular to the beams 11. The beams 11, 12 each have an I-shaped cross-section. The entire apparatus is intended to be installed into a shallow trench or some other underground excavation, generally denoted 10, so that the floor beams 11 rest on the floor of the excavation 10 while the rear beams 12 contact a rear end wall of the excavation 10 remote from a front end wall through which pipes or similar tubular structures are to be driven with the apparatus. The frame also has a transverse yoke 14 and a transverse front cross-piece or beam 26 rigidly interconnecting the floor beams 11.

A displaceable force-applying means in the form of a pressure ring 15, which can be hollow and of square or box-shaped cross-section as illustrated, is arranged at the forward end of the apparatus. This ring 15 serves to engage directly on the endmost of a series of the pipes or similar tubular structures (not shown) arranged end-to-end to drive the pipes longitudinally into the ground. In order to achieve this power means is provided to move the ring 15 back and forth parallel to the beams 11. This power means takes the form of double-acting hydraulic piston and cylinder units or rams 13. Four such units 13 are depicted in the drawing although in general two or more units can be provided.

Each unit 13 has its cylinder connected flexibly through a ball-and-socket joint 17 to one of the rear beams 12 so that the beams 12 engaging on the rear end wall of the excavation 10 constitute a thrust abutment for the units 13. Similarly, each of these units 13 has its piston rod 13 connected flexibly through a ball-and-socket joint 16 to the ring 15. Extension or retraction of the units 13 moves the ring 15 parallel to the beams 11. More particularly, extension of the units 13 causes the ring 15 to move forwards to urge the pipes outwardly as a series while retraction of the units 13 moves the ring 15 rearwardly to permit the introduction of a fresh pipe at the end of the series prior to a fresh driving stroke. Thus alternate retraction and extension of the units 13 will permit the overall pipe line to be progressively increased in length.

Figure 3:
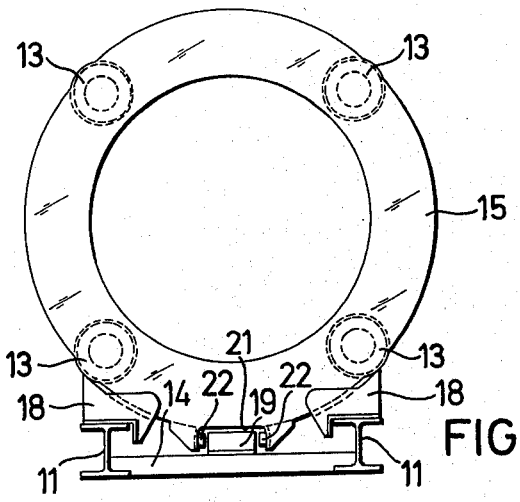
FIG. 3 is a schematic end view of the apparatus shown in FIGS. 1 and 2.

In order to positively support and guide the ring 15 during its movement, as effected by the units 13, guide shoes 18 are provided. These guide shoes 18 have planar lower faces which slidably engage on the floor beams 11, and more particularly on the upper flanges thereof as shown in FIG. 3, to permit movement of the ring 15 parallel to the beams 11. The shoes 18 also have downwardly-projecting tongues which locate over the inner edges of the upper flanges of the beams 11 to restrain lateral movement of the shoes 18. The shoes 18 are each designed to receive part of the ring 15, for example in a recess defined between parallel walls of the shoe 18 extending laterally of the beams 11. In this way, the ring 15 is located in and supported by the shoes 18. Although the ring 15 moves axially, i.e., parallel to the beams 11, with the shoes 18 it is arranged that the shoes 18 permit at least partial rotation of the ring 15 about its axis. This can be accomplished, for example, by ensuring that the recesses in the shoes 18 are unobstructed laterally of the beams 11.

Figure 2:
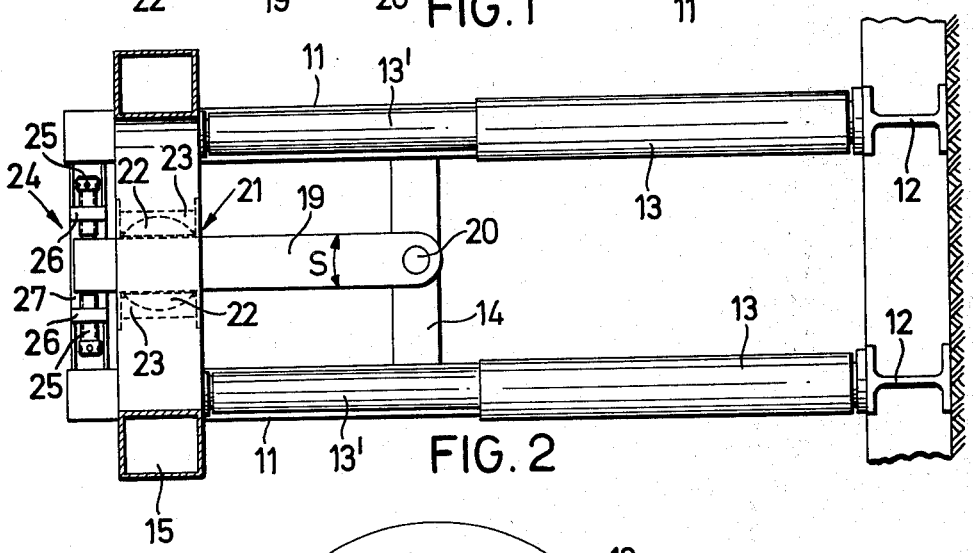
FIG. 2 is a schematic part-sectional plan view of the apparatus shown in FIG. 1.

A guide rail 19, which serves as means for adjusting the rotational position of the ring 15, is located between the beams 11 and is pivotably connected to the connection yoke 14 with the aid of a pivot pin 20 so as to be swingable in the directions denoted by arrow S in FIG. 2.

The rail 19 extends beneath the ring 15 so as not to obstruct the axial movement of the ring 15 parallel to the beams 11. The ring 15 is provided with lugs or similar projections on its exterior periphery which define a gap or recess 21 through which the rail 19 extends. The rail 19 can rest on the floor. Guide means is provided on the ring 15 for co-operation with the rail 19 and this guide means takes the form of a pair of guide elements 22 engageable on opposite sides of the rail 19 and located in self-adjusting curvilinear bearings 23 provided on the inside of the lugs. The guide means (22) translates pivotable motion of the rail 19 to part rotation of the ring 15. A mechanism, generally designated 24, is provided for adjusting the position of the rail 19 and thereby the ring 15. This mechanism takes the form of two opposed screw-threaded members 25, e.g., set screws located in screw-threaded bores in brackets 26 supported on the cross beam 27 and contacting the opposite sides of the rail 19.

During the tube-driving operation discussed hereinbefore the rail 19 can be adjusted to a variety of angular positions. In general the rail 19 is adjusted and set with the members 25 to adjust the ring 15 to a certain rotational position. The joints 16 permit the unit 13 to assume a slightly inclined disposition in relation to the axis of the ring 15 to accommodate such adjustment of the ring 15. This, in turn, sets up a certain restoring torsional control force acting about the axis of the ring 15 and this force will be transmitted frictionally to the pipe line as the ring 15 is advanced by the units 13. The ring 15 is reliably guided by the guide means (22), and the shoes 18 during its advance despite any pre-adjustment of its rotational position. It can be arranged for the torsional control force imparted to the pipe line by virtue of the adjustment of the ring 15 to set up a stress which tends to oppose or even, ideally balance out any residual torsional stress or torsional force which, as is known, may be set up in the pipe line regardless of the rotational position of the ring 15.

The guide rail 19 and associated parts enable the magnitude and direction of the control force to be varied to cope with prevailing conditions. Thus, with the rail 19 in a central, neutral position as illustrated there would be no control force set up but the rail 19 can be moved either side of this neutral position to move the ring 15 in one direction or the other to set up consequential control forces in one direction or the other.

I claim:

1. A tube-driving apparatus which includes force-applying means engageable with a pipe and movable to drive said pipe into the ground, means for mounting said force-applying means for movement about a rotational axis extending parallel to the driving direction and means for pre-adjusting the force-applying means in relation to said rotational axis whereby to control the torsional force imparted to the pipe during the driving operation.

2. A tube-driving apparatus comprising pressure means engageable with a pipe, power means for moving the pressure means to drive said pipe into the ground, resilient means flexibly interconnecting the pressure means to the power means and means for adjusting the pressure means about an axis extending parallel to the driving direction to set up a torsional force in the pressure means whereby to control the torsion imparted to the driven pipe.

3. In a tube-driving apparatus comprising a plurality of piston and cylinder units, pressure means connected to the units for engagement with a pipe and for urging the pipe into the ground when the units are operated; the improvement comprising means for adjusting and controlling the position of the pressure means about a rotational axis extending parallel to the driving direction to create a torsional force in the pressure means for imparting to the tube to be driven.

4. A tube-driving apparatus comprising a pressure ring supported for axial and rotary movement and engageable with a pipe to be driven, piston and cylinder units for moving the ring axially to urge said tube into the ground and means for adjusting the position of the ring about its rotational axis to create torsional force in the ring whereby to control the torsion in the driven pipe.

5. An apparatus according to claim 4, wherein there is provided a frame with components forming an abutment for the piston and cylinder units.

6. An apparatus according to claim 5, wherein the frame has floor-engaging beams andd further rear beams disposed perpendicular to the floor-engaging beams and constituting the abutment-forming components.

7. An apparatus according to claim 4, wherein the adjusting means comprises a rail locating on the exterior of the ring and displaceable transversally to the rotational axis of the ring.

8. An apparatus according to claim 7, wherein the rail is supported for pivoting to produce the transverse displaceability and there is further provided a mechanism for varying the pivotal position of the rail.

9. An apparatus according to claim 8, wherein the pivot axis of the rail is located at the side of the ring adjacent the piston and cylinder units.

10. An apparatus according to claim 4, wherein the piston and cylinder units are connected to the pressure ring through flexible means.

11. An apparatus according to claim 4, wherein the piston and cylinder units are connected to the pressure ring through ball-and-socket joints.

12. An apparatus according to claim 5, wherein the piston and cylinder units are connected to the abutment-forming components of the frame and to the ring with the aid of ball-and-socket joints.

13. An apparatus according to claim 7, wherein guide means is provided to act between the ring and the rail.

14. An apparatus according to claim 13, wherein the ring has lugs on its exterior which define a recess through which the rail extends and there are guide elements located in self-adjusting bearings at the inside of the lugs which engage on the opposite sides of the rail and constitute the guide means.

15. An apparatus according to claim 8, wherein said mechanism is located at the side of the ring remote from the piston and cylinder units.

16. An apparatus according to claim 6, wherein the pressure ring is supported by guide shoes which slidably engage on the floor beams and permit the rotary movement of the pressure ring.

17. An apparatus according to claim 8, wherein said mechanism is a pair of screw threaded members engaging on opposite sides of the rail.

* * * * *